US006092559A

United States Patent [19]

Dvorak et al.

[11] Patent Number: 6,092,559

[45] Date of Patent: Jul. 25, 2000

[54] DEVICE FOR CONTROLLING WARP THREADS FOR THE PRODUCTION OF LENO FABRICS ON A TEXTILE MACHINE

[75] Inventors: Josef Dvorak, Liberec; Jiri Mylnar, Chrastava; Miroslav Rydval; Petr Karel, both of Liberec, all of Czech Rep.

[73] Assignees: BP Amoco Corporation, Chicago, Ill.; Vyzkummy Ustav Textilnich Stroju Liberec A.S., Liberec, Czech Rep.

[21] Appl. No.: 09/230,621

[22] PCT Filed: Jul. 24, 1997

[86] PCT No.: PCT/CZ97/00025

§ 371 Date: Mar. 23, 1999

§ 102(e) Date: Mar. 23, 1999

[87] PCT Pub. No.: WO98/07913

PCT Pub. Date: Feb. 26, 1998

[30] Foreign Application Priority Data

Aug. 16, 1996 [CZ] Czech Rep. ..... 2425-96

[51] Int. Cl.[7] ..... D03D 19/00; D03C 7/06

[52] U.S. Cl. ..... 139/50; 139/54

[58] Field of Search ..... 139/54, 50, 48

[56] References Cited

U.S. PATENT DOCUMENTS

| | | | |
|---|---|---|---|
| 2,647,541 | 8/1953 | Nichols | 139/50 |
| 4,614,210 | 9/1986 | Debaes | 139/54 |
| 5,123,454 | 6/1992 | Debaes | 139/54 |

FOREIGN PATENT DOCUMENTS 280643 2/1996 Czech Rep. .

*Primary Examiner*—Andy Falik
*Attorney, Agent, or Firm*—Notaro & Michalos P.C.

[57] ABSTRACT

A device for controlling warp threads in weaving of leno fabrics on a weaving device, such as a loom, has a guide mechanism for stationary warp threads and rotating warp threads. The guide mechanism includes a system of reversibly movable needles with eyes for passage of the stationary warp threads and a reversibly movable guide member for the stationary warp threads that is driven in association with the needles. The guide mechanism also has a vertically adjustable member with a plurality of oblique slots for the rotating warp threads for effecting side-to-side movement thereof as a result of vertical movement of the rotating warp threads within the slots, and an adjustably mounted compensation mechanism.

13 Claims, 2 Drawing Sheets

DEVICE FOR CONTROLLING WARP THREADS FOR THE PRODUCTION OF LENO FABRICS ON A TEXTILE MACHINE

FIELD OF THE INVENTION

The invention relates to a device for controlling warp threads for the production of leno fabrics on a textile machine comprising a reed equipped with gliders separated from each other by slots intended to guide pairs of warp threads, one of which belongs to a system of stationary warp threads, and the other, to a system of rotating warp threads. In the direction of the warp thread movement during the weaving process, a system of needles fitted with eyes for guiding the system of stationary warp threads, reversibly moveable, is arranged in front of the reed and coupled with a mechanism adapted to impart to it said reversible movement in front of which vertically adjustable heddle frames are situated. A first heddle frame has oblique slots for the passage of the rotating warp threads, the other one, a straight slot passing through the whole width of the warp for the passage of the warp thread system.

BACKGROUND OF THE INVENTION

Fabrics with leno weave show specific properties resulting from the different construction of the crossing point, the crossing proper and, consequently, the thread interlacing being achieved by the mutual turning of two warp threads around each other thereby eliminating the need to interlace the weft with said warp threads. In each weaving cycle, its position is each time over one and the same, and under the other, of the warp thread systems, said warp threads bringing about the interlacing effect not by mutually alternating the upper and the lower position but by their mutual turning around each other.

Thus, the warp threads are divided into two groups, i.e., into the stationary and the rotating ones. Special mechanisms are required to generate their mutual movement normal to their axis.

The known embodiments of such devices contain special leno heddles and return motion half-heddles.

Another embodiment makes use of shaft frames equipped with needles instead of with heddles. Here, the shaft frames, in addition to their shed forming motion, carry out a mutual reversible motion parallel with the direction of the shed insertion.

Another known method of leno weave creation is described in the patent CZ No. 280643 relating to a device for binding the fabric edge on weaving machines. Its advantage over the preceding ones consists in the method of generating the required motion of the rotating warp threads by means of an oblique slot provided in the shaft frame carrying out the standard shed motion so that, unlike the preceding embodiment, the shaft frame need not move in two directions and, consequently, the arising dynamic forces are substantially reduced, and the mechanism is simplified. In comparison with the embodiment using special heddles, this embodiment contains no further components such as half-heddles for mediating the positive contact with the warp threads and whose motion shows discontinuous changes during the heddle frame alternations that by their impacts have adverse effects on the operation frequence of the weaving machine. However, the drawback of the mechanism described in the patent CZ 280643 consists in that it permits to produce the leno weave only with a limited number of warp threads on the fabric edge, and not a complete leno fabric.

Another drawback of the described embodiment consists in that it fails to ensure the same tension in each of the two warp thread systems, and consequently, in the uneven proportionate elongation during the weaving process. For this reason, warp threads to be interlaced in this way must be supplied from special accessory warp thread bobbins, each of them equipped with an independently adjustable brake.

Another well-known device for producing the gauze weave on the fabric edge is described in EP 152 956 A2 and EP 450 120 A1, intended for double gripper looms for weaving double fabrics. For producing the edge on each fabric, it comprises one system of stationary threads, and two systems of laterally deflectable movable threads. The movable threads are led across oblique grooves responsible for their movement like in the preceding solution, and the stationary threads are led from supplementary warp bobbins into the eyes of the vertically movable threads while passing through a guide aperture provided in the needle holder situated outside the longitudinal axis of the needle so that the rotating threads are spliced/interconnected with each other only in the front shed, i.e., in the section between the beat-up point and the needle's eye, but are permanently separated from each other in the section between the guide aperture in the needle holder and the warp bobbin. After passing through the guide aperture, the stationary threads make a turn of 90° and pass along the needles into the needle eyes from the needle front side to the needle rear side after which they again arrive at the needle front side. The drawback of this solution consists in particular in great strain imposed on the stationary threads so that the device can be used only for the creation of the fabric edges where the warp threads are supplied from special supplementary warp bobbins with individual adjustment of the thread tensions or with the thread tension adjustment carried out separately for the stationary threads on the one hand and for the movable warp threads on the other hand.

DISCLOSURE OF THE INVENTION

The above drawbacks of the state of art have been eliminated by the device for controlling warp threads according to this invention whose principle consists in that at least one guide member of the stationary warp thread system situated over the heddle frames in parallel with them is coupled with the system of needles fitted with eyes and that at least two compensation rollers of the rotary warp thread system are mounted on a third heddle frame, the guide member of the system of the stationary threads being situated in front of the plane passing through the system of needles fitted with eyes, considered in the direction of the travel of the warp threads.

The device permits to keep equal traction forces both in the system of stationary warp threads and in the system of rotating warp threads and to eliminate the differences of their proportionate elongation in the area extending from the beat-up point to the whip roll during the weaving cycle and weaving process on a weaving machine and permits a continuous passage of stationary warp threads without sharp bends.

Preferably, the compensation rollers of the rotating warp thread system, mounted on the third heddle frame, are arranged adjustably with respect to this third heddle frame, thus permitting to form and adjust the required angle of contact of the rotating strand of the warp threads for producing the frictional resistance whose values are then continuously identical with the resistance of the warp threads in the stationary strand.

Also preferably, the compensation rollers of the rotating warp thread system are mounted on a swinging shaft, adapted reversingly to swing on the third heddle frame (and coupled with the drive mechanism). This permits easily and continuously to change the angle of contact of the rotating warp thread system on the compensation rollers and by means of this, to modify the frictional force acting on the warp threads of the rotating warp thread system.

Preferably, the guide member of the stationary warp thread system is made as a longitudinal bar parallel with the heddle frames.

To obtain the optimum function of the mechanism, the guide member is preferably mounted on the connecting rods of the mechanism used to bring about the reversible motion of the system of needles fitted with eyes.

The advantage of this embodiment consists in the fact that the needle stroke governing the motion of the stationary warp thread system passing over the guide member is approximately the same as the stroke of the oblique guide slots governing the motion of the rotating warp thread system. Each warp thread belonging to the stationary warp thread system passes through the needle's eye carrying out a substantially rectilinear reversible motion during the shed formation. After the warp thread system has left the needle, these warp threads pass via the guide member situated on the connecting rod of the drive mechanism. The trajectory of the guiding of this system has been chosen so as to ensure that the total length of the warp thread belonging to the stationary warp remains constant in the whole section between the beat-up point and the whip roll during the weaving cycle. Having passed through the oblique guide slots provided in the heddle frame, the warp threads belonging to the rotating warp thread system pass through a compensation loop consisting of a pair of compensation rollers situated preferably as near as possible the heddle frame equipped with oblique slots.

The equal tension of the two warp strands in the area of the fabric formation ensures equal weaving ability and fabric quality. Moreover, the elimination of the difference in the proportionate elongation through the section from the harness to the whip roll permits to make use of only one warp beam and only one whip roll.

SPECIFIC DESCRIPTION

Figure 1:
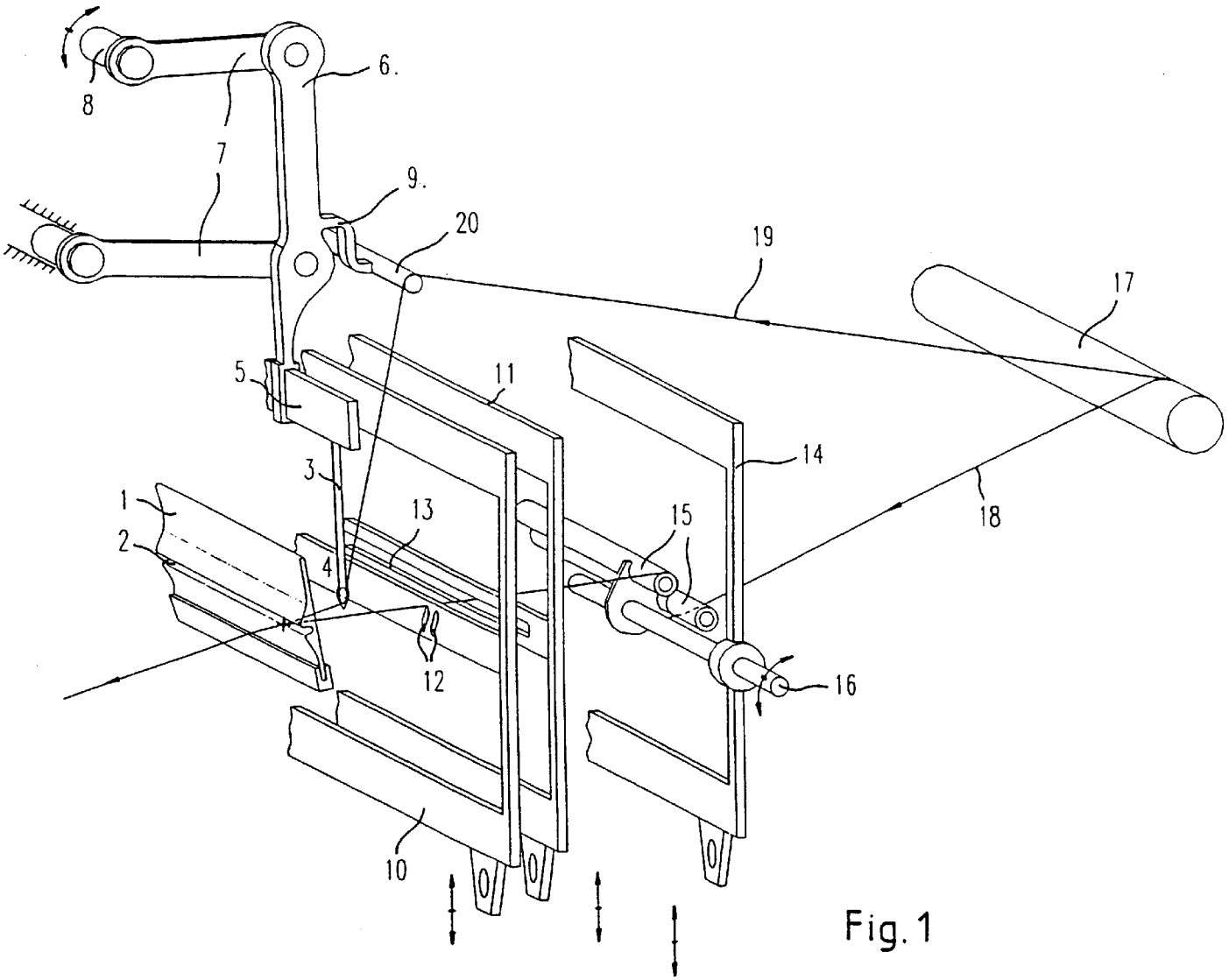
FIG. 1 is a perspective view of an example of embodiment of the device according to the invention.

The device for controlling warp threads shown in FIG. 1 is a part of a weaving machine having a well-known reed 1 with a pick channel 2 of a weft 21 fixed to a not represented batten. In front of the reed 1 in the direction of the warp thread motion, a system of needles 3 fitted with eyes 4 and fixed to a fixing member 5 fixed in turn to at least two reversibly moveable connecting rods 6 is arranged. Situated reversibly moveable in vertical direction in front of the system of said needles 3 is a first heddle frame 10 fitted with a row of oblique slots 12, a second heddle frame 11 fitted with a rectilinear slot 13, and a third heddle frame 14 fitted with a pair of compensation rollers 15 seated reversibly moveable with respect to the shaft frame of the third heddle frame 14, for instance fixed to a swinging shaft 16 coupled with a not represented drive. A whip roll 17 is mounted in front of the heddle frames 10, 11, 14 in the direction of the warp thread motion. The designation of the heddle frames as "first", "second", and "third" relates to the heddle frames actively participating in the formation of the leno weave according to the invention. In case of need, the weaving machine can comprise further well-known heddle frames situated in front, between, or behind, the heddle frames 10, 11, 14.

The connecting rods 6 are mounted for instance on a two-balance beam drive mechanism 7 with a drive pin 8, as is the case in the shown example of embodiment. On the side turned away from the drive mechanism 7, each connecting rod 6 is fitted with a holder 9 having fixed thereto a guide member 20 of a system of stationary warp threads 19 consisting in the shown example of embodiment of a bar. This guide member 20 is arranged in parallel with the heddle frames 10, 11, 14 and over the heddle frames 10, 11 and is situated in front of the plane passing through the system of the needles (3) fitted with eyes (4), considered in the direction of the travel of the warp threads, as shown in FIG. 1

The warp threads are drawn-off from a not represented warp beam via the whip roll 17. From the whip roll onward, they are distributed into a system of rotating warp threads 18 and a system of stationary warp threads 19. The system of rotating warp threads 18 is led from the whip roll 17 into the pair of the compensation rollers 15 that bend through the rotating warp threads 18 and thus produce the contact angle required for creating areas of frictional resistance. Preferably, the compensation rollers 15 are situated so as to obtain as small as possible distance between the axis of the first roller and the second heddle frame 11. The mutual position of the compensation rollers 15 can be either fixed or adjustable. Depending on the program required, the required value of the frictional resistance forces acting on the system of the rotating warp threads 18 can be adjusted. Also, the compensation rollers 15 can change their actual position with respect to a not represented weaving plane in accordance with the required program, for instance by changing the angular position of the swinging shaft 16 on which they are fixed as shown in FIG. 1.

From the pair of the compensation rollers 15 on, the system of the rotating warp threads 18 is led into the rectilinear slot 13 of the second heddle frame 11 and from there, each rotating warp thread 18 of the system is led into its respective oblique slot 12 of the first heddle frame 10 and then between the respective gliders of the reed 1. The system of the stationary warp threads 19 is led from the whip roll 17 upwards over the heddle frames 10, 11, 14 and via the guide member 20. From the guide member 20, each stationary warp thread 19 of the system is then led continuously into the eye 4 of the respective needle 3 and further on, like the rotating warp threads 18, separately between the respective gliders of the reed 1. Thus, each slot between the gliders of the reed 1 receives one rotating warp thread 18 and one stationary warp thread 19 of the respective systems. As is shown in FIG. 1, each stationary warp thread 19 lies in a plane passing through the longitudinal axis of the needle 3 through whose eye 4 it passes. During the movement of the system of needles 3 downward accompanied by the simultaneous movement of the first and second heddle frames 10, 11 upward, the system of stationary warp threads 19 and the system of the rotating warp threads 18 produce in a well-known not represented manner the shed for the insertion of a not represented weft.

The needles 3 are situated at all times in the axis of the respective oblique slot 12 of the first heddle frame 10. The side of the needle 3 the respective rotating warp thread 18 will turn around, is determined by its position in the oblique slot 12 of the first heddle frame 10, and the displacing of the rotating warp thread 18 in said oblique slot 12 is carried out by the force exerted by the edges of the rectilinear slot 13 of the second heddle frame 11. The action of the upper or lower edge of the rectilinear slot 13 on the rotating warp thread 18 is due to the difference in amount, or in speed, of the stroke of the first heddle frame 10 and the second heddle frame 11.

If the velocity of the second heddle frame 11 is superior to that of the first heddle frame 10, the edges of the rectilinear slot 13 will push the rotating warp thread 18 of the system out of the upper position in the oblique slot 12 of the first heddle frame 10, and vice versa.

Figure 2:
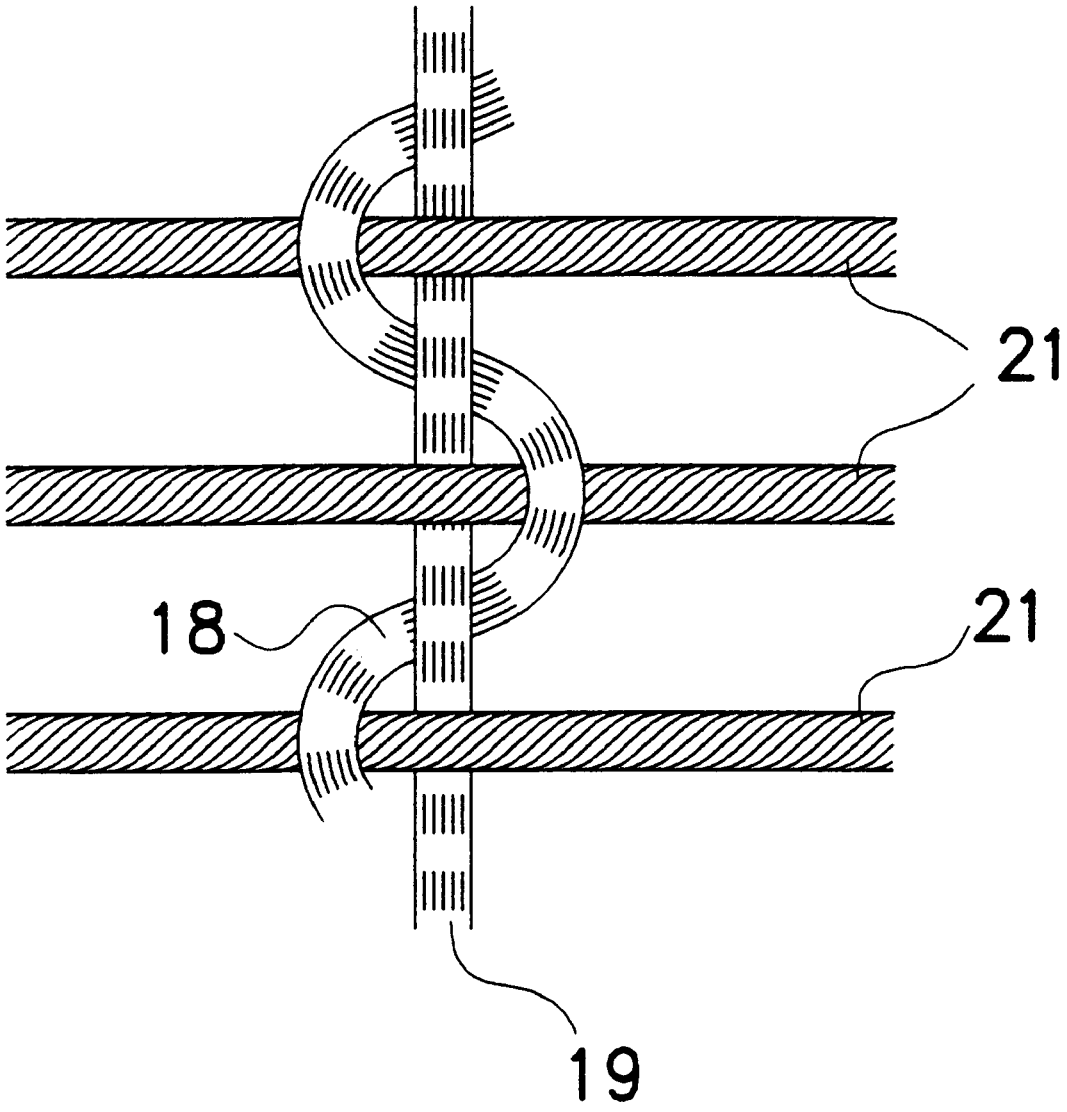
FIG. 2 shows the structure of the gauze weave in a fabric produced on a weaving machine according to the invention.

In this way, the rotating warp threads 18 are being moved with respect to the stationary warp threads 19 and subsequently interlaced with the weft 21 in the form of the leno weave, as shown in FIG. 2.

The trajectory of the motion of the guide member 20 is chosen so as ensure that the total length of the system of the stationary warp threads 19 led via the guide member 20 remains constant throughout the weaving cycle in the section from the beat-up point to the whip roll 17.

In this way, undesirable changes in the tension of the stationary warp threads 19 in the course of the weaving process are eliminated.

What is claimed is:

1. A device for controlling warp threads in the production of leno fabrics on a textile machine comprising a reed equipped with gliders separated from each other by slots intended to guide pairs of warp threads, one of which threads belongs to a system of stationary warp threads and the other to a system of rotating warp threads, said device comprising a reversibly movable system of needles fitted with eyes and at least one guide member that is reversibly movable in association with the needles for guiding the stationary warp threads, said system of needles being coupled with a mechanism adapted to impart to said system of needles said reversible movement, the device further comprising vertically adjustable frames situated in front of said system of needles and parallel to the guide member, a first such frame having oblique slots for the passage of the rotating warp threads, a second such frame having a straight slot passing therethrough across the whole width of the warp for the passage of the rotating warp thread system, and at least two compensation rollers being mounted on a third frame, the guide member being situated in front of a plane passing through the system needles.

2. A device as claimed in claim 1, wherein the compensation rollers (15) of the rotating warp thread system (18) are mounted on the third frame (14) adjustably with respect to this third frame (14).

3. A device as claimed in claim 2, wherein the compensation rollers (15) of the rotating warp thread system (18) are mounted on a swinging shaft (16), adapted reversingly to swing on the third frame (14) and coupled with a drive mechanism.

4. A device as claimed in claim 1, wherein the guide member (20) of the stationary warp thread system (19) is a longitudinal bar parallel to frames (10, 11, 14).

5. A device as claimed in claim 4, wherein the guide member (20) is mounted on connecting rods (6) of the mechanism used to impart the reversible motion to the system of needles (3) fitted with eyes (4).

6. A device for controlling stationary warp threads and rotating warp threads in the production of leno fabrics on a textile machine, said device comprising:

reversibly movable needles, each having an eye adapted for passage of a stationary warp thread therethrough;

a guide member for the stationary warp threads adapted for reversible movement in association with the needles;

rotating warp thread guide means in front of, and adapted for reversible, vertical movement in association with, the needles and comprising at least one member having a plurality of oblique slots adapted for passage of rotating warp threads therethrough and to impart side-to-side motion to the rotating warp threads as a result of vertical movement of the rotating warp threads within the oblique slots; and adjustable compensation means located in front of said guide member for controlling tension on the rotating warp threads.

7. The device of claim 6, wherein-the guide member for the stationary warp threads is mounted above the rotating warp thread guide system.

8. The device of claim 6, wherein the rotating warp thread guide means comprises a first frame having said plurality of oblique slots therein.

9. The device of claim 8, wherein the rotating warp thread guide means comprises a member having a slot across the width of the warp.

10. The device of claim 9, wherein the compensation means comprises at least two adjustably mounted rollers.

11. The device of claim 6, wherein the rotating warp thread guide means comprises a first frame having said plurality of oblique slots therein and a second frame in front of the first frame and having a rectilinear slot across the width of the warp.

12. A method for producing a leno fabric comprising the steps of:

providing a plurality of threads comprising stationary warp threads and rotating warp threads:

passing the rotating warp threads through a plurality of oblique slots in a guide;

reversibly adjusting a vertical position of the rotating warp threads within the slots to impart side-by-side movement to the threads;

maintaining constant tension on the rotating warp threads during said adjustment of their vertical position;

reversibly adjusting a vertical position of the stationary warp threads in association with the side-to-side movement of the rotating warp threads to interlace the rotating warp threads with the stationary warp threads and form a shed for insertion of a weft thread; and inserting a weft thread into the shed.

13. The method of claim 12, wherein the stationary warp threads are provided from a whip roll, the fabric is advanced to a beat up position after insertion of the weft thread into the shed and the stationary warp threads have trajectories of equal distance from the whip roll to the beat up position.

* * * * *